US010563386B2

(12) United States Patent
Schuster

(10) Patent No.: US 10,563,386 B2
(45) Date of Patent: Feb. 18, 2020

(54) GARBAGE DISPOSAL STOPPER/STRAINER

(71) Applicant: Danco, Inc., Irving, TX (US)

(72) Inventor: Michael J. Schuster, Shorewood, IL (US)

(73) Assignee: DANCO, INC., Irving, TX (US)

( * ) Notice: Subject to any disclaimer, the term of this patent is extended or adjusted under 35 U.S.C. 154(b) by 54 days.

(21) Appl. No.: 15/973,292

(22) Filed: May 7, 2018

(65) Prior Publication Data

US 2018/0320350 A1 Nov. 8, 2018

Related U.S. Application Data

(60) Provisional application No. 62/502,981, filed on May 8, 2017.

(51) Int. Cl.

| | |
|---|---|
| ***E03C 1/262*** | (2006.01) |
| ***A47L 17/06*** | (2006.01) |
| ***A47K 1/14*** | (2006.01) |

(52) U.S. Cl.

CPC ..... *E03C 1/262* (2013.01); *A47K 1/14* (2013.01); *A47L 17/06* (2013.01)

(58) Field of Classification Search

CPC ..... E03C 1/262; A47K 1/14
USPC ..... 4/286–295
See application file for complete search history.

(56) References Cited

U.S. PATENT DOCUMENTS

2019/0024355 A1* 1/2019 Sebolt ..... E03C 1/2302

* cited by examiner

*Primary Examiner* — Christine J Skubinna
(74) *Attorney, Agent, or Firm* — Thomas Horstemeyer, LLP

(57) ABSTRACT

Disclosed are various embodiments for a garbage disposal strainer and stopper. The garbage disposal strainer and stopper can include a base. It can also include a top that includes a cavity and a first shaft. The garbage disposal strainer and stopper can also include an insert that is configured to fit within the cavity of the top. The insert further can also include a second shaft. Moreover, the garbage disposal strainer and stopper can include a cap configured to fit through the first shaft in the top and the second shaft in the insert and engage the base. The cap can include a rim extending past an external wall of the first shaft.

19 Claims, 8 Drawing Sheets

GARBAGE DISPOSAL STOPPER/STRAINER

CROSS-REFERENCE TO RELATED APPLICATIONS

This application claims priority to, and the benefit of, U.S. Provisional Patent Application No. 62/502,981, entitled "GARBAGE DISPOSAL STOPPER/STRAINER" and filed on May 8, 2017, which is incorporated by reference as if set forth herein in its entirety.

BACKGROUND

Sinks often have garbage disposals. These garbage disposals allow for an owner to dispose of particulate matter in a drain by shredding the particulate matter when operated.

BRIEF DESCRIPTION OF THE DRAWINGS

Many aspects of the present disclosure can be better understood with reference to the following drawings. The components in the drawings are not necessarily to scale, with emphasis instead being placed upon clearly illustrating the principles of the disclosure. Moreover, in the drawings, like reference numerals designate corresponding parts throughout the several views.

DETAILED DESCRIPTION

Figure 1:
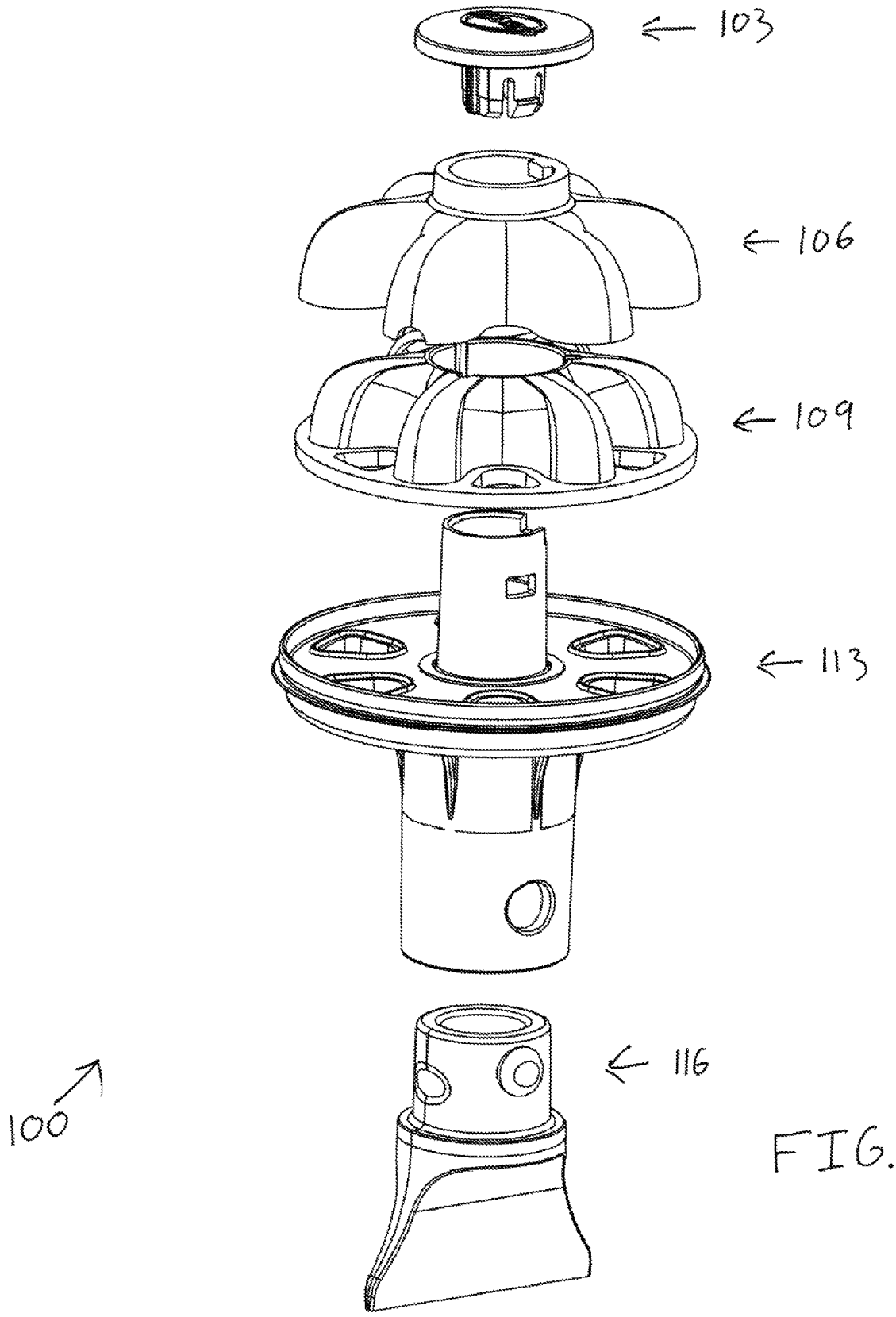
FIG. 1 is a drawing of an exploded view of a garbage disposal stopper/strainer, according to various embodiments of the present disclosure.

With reference to FIG. 1, shown is an exploded view of a garbage disposal stopper/strainer 100 according to various embodiments of the present disclosure. The garbage disposal stopper/strainer 100 includes a cap 103, a top 106, an insert 109, a base 113, and a scraper 116. The cap 103 is configured to fit through the top 106 and insert 109 and engage the base 113, thereby securing or fastening the top 106 and insert 109 to the base 113. The insert 109 and the base 113 include one or more holes, as further described herein. The holes of the insert 109 and the base 113 are alignable. When the top 106 is rotated, the insert 109 is caused to rotate, bringing the holes of the insert 109 and the base 113 into or out of alignment. When the holes of the insert 109 and the base 113 are aligned, liquids are allowed to pass through the garbage disposal stopper/strainer 100, while larger objects (e.g., food stuffs, silverware, jewelry, etc.) is prevented from passing through the garbage disposal stopper/strainer 100. When the holes of the insert 109 and the base 113 are out of alignment (e.g., non-overlapping), the flow of liquids is reduced or stopped, preventing or reducing the flow of liquids from the sink into the drain.

FIGS. 2A-2D illustrate in further detail the cap 103 of the garbage disposal stopper/strainer 100, according to various embodiments of the present disclosure.

Figure 2A:
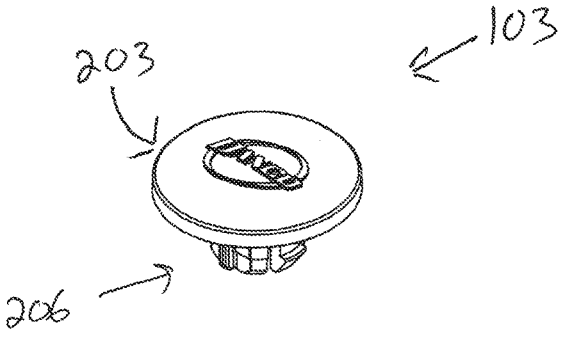
FIGS. 2A-2D are drawings of a cap of the garbage disposal stopper/strainer, according to various embodiments of the present disclosure.

FIG. 2A is perspective view of the cap 103. As illustrated, the cap 103 includes a rim 203 occupying a plane perpendicular to a base 206 of the cap. The rim 203 serves several purposes. First, the rim 203 of the base serves to secure the top 106 and insert 109 to the base 113 of the garbage disposal stopper/strainer 100 by preventing the top 106 and the insert 109 from sliding off of the base 113 when the cap 103 is fastened to the base 113. Second, the rim 203 helps to prevent flowing liquids over the garbage disposal stopper/strainer 100 from entering the garbage disposal stopper/strainer 100.

Figure 2B:
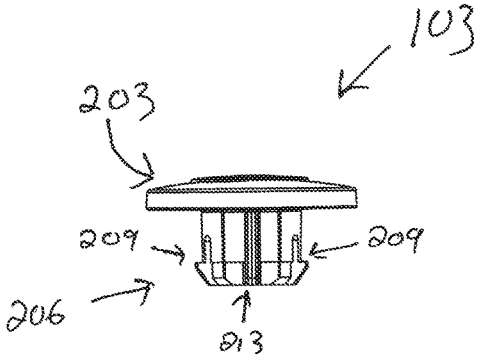

FIG. 2B is a side view of the cap 103. As illustrated, the rim 203 is disposed on the base 206 of the cap 103. The base 206 includes at least one fastener 209, such as a clasp, clip, or latch. The base 206 also includes a ridge 213 disposed along the length of the base 206.

Figure 2C:
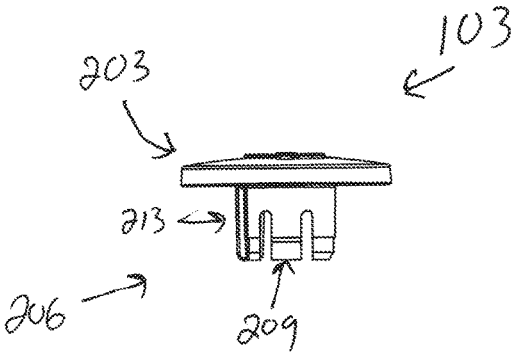

FIG. 2C is a side view of the cap 103 from a perspective rotated 90° relative to the view depicted in FIG. 2B. As shown, the cap 103 includes a rim 203 and a base 206. The base 206 of the cap 103 further includes at least one fastener 209 and a ridge 213 disposed along the length of the base 206.

Figure 2D:
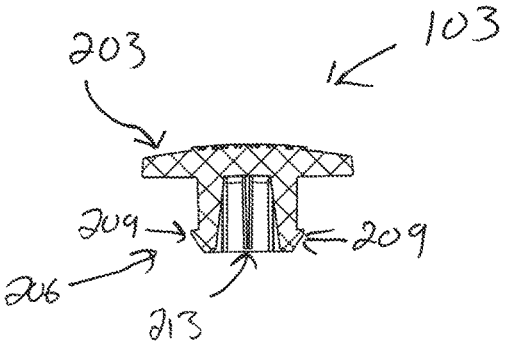

FIG. 2D is a cross-sectional view of the cap 103 from the perspective illustrated in FIG. 2B. The cap 103 includes a rim 203 and a base 206. The base 206 of the cap 103 further includes at least one fastener 209 and a ridge 213 disposed along the length of the base 206.

FIGS. 3A-3E illustrate in further detail the top 106 of the garbage disposal stopper/strainer 100, according to various embodiments of the present disclosure.

Figure 3A:
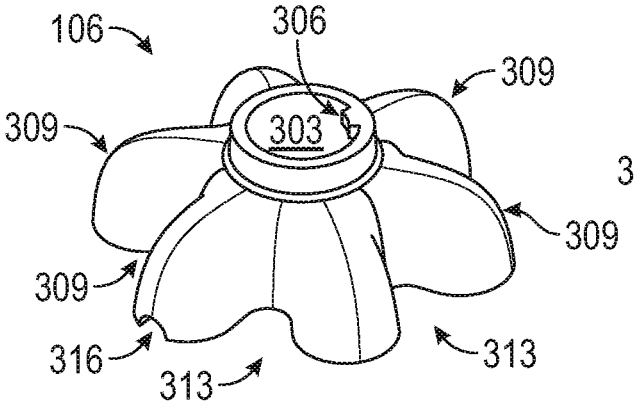
FIGS. 3A-3E are drawings of a top of the garbage disposal stopper/strainer, according to various embodiments of the present disclosure.

FIG. 3A provides a perspective illustration of an example of the top 106, according to various embodiments of the present disclosure. The top 106 includes a hollow shaft 303. A stud 306 protrudes from an interior wall of the hollow shaft 303. As illustrated, the stud 306 protrudes from a position on the interior wall of the hollow shaft 303 at or near the upper rim of the hollow shaft 303. However, the stud 306 may be placed in other locations on the interior wall of the hollow shaft 303 as appropriate, according to various embodiments of the present disclosure. The top 106 also includes a plurality of fingers 309 shaped to form a channel 313 between any two adjacent fingers 309. The channels 313 formed by the fingers 309 serve to direct the flow of liquids over the top 106. A finger 309 may also include a hole 316 at its base to allow liquids to drain from any gap or space that may form between the top 106 and the insert 109.

Figure 3B:
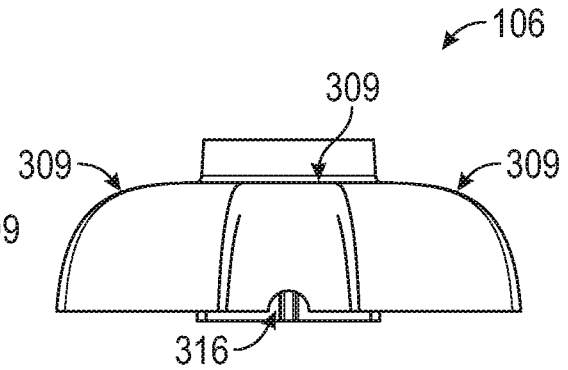

FIG. 3B provides a side-view of the top 106 according to various embodiments of the present disclosure. The depiction in FIG. 3B shows an example arrangement of multiple fingers 309 and a hole 316 present in the base of at least one of the fingers 309.

Figure 3C:
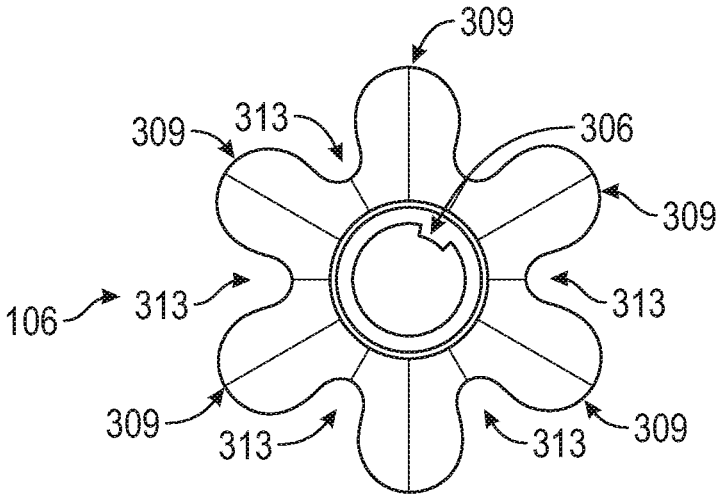

FIG. 3C provides a top-down view of the top 106 according to various embodiments of the present disclosure. The hollow shaft 303 is illustrated as is the stud 306 protruding from the interior wall of the hollow shaft 303. Multiple fingers 309 are illustrated, as are individual channels 309 formed between each pair of adjacent fingers 309.

Figure 3D:
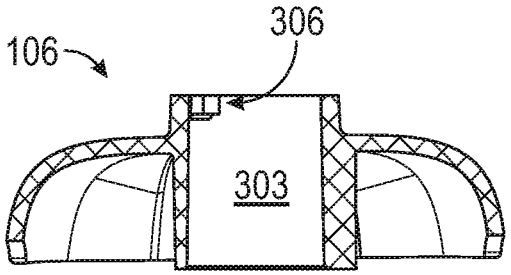

FIG. 3D provides a cross-section of the side view illustrated in FIG. 3B, according to various embodiments of the present disclosure. As shown, the hollow shaft 303 includes a stud 306 protruding from the interior wall of the hollow shaft 303. Also illustrated is that the hollow shaft 303 and the fingers 309 form a cavity, which allows for the insert 109 to be inserted into the top 106 as illustrated previously in FIG. 1.

Figure 3E:
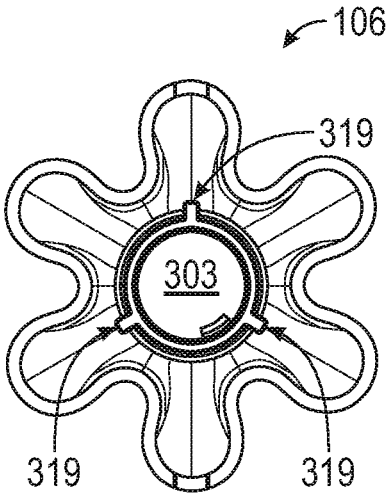

FIG. 3E is a bottom-up view of the top 106 according to various embodiments of the present disclosure. One or more ridges 319 located within the cavity formed by the hollow shaft 303 and the fingers 309 of the top 106 are disposed along the length of an exterior wall of the hollow shaft 303. As further discussed, herein, the ridges 319 help to secure the insert 109 to the top 106.

FIGS. 4A-4D illustrate in further detail the insert 109 of the garbage disposal stopper/strainer 100, according to various embodiments of the present disclosure.

Figure 4A:
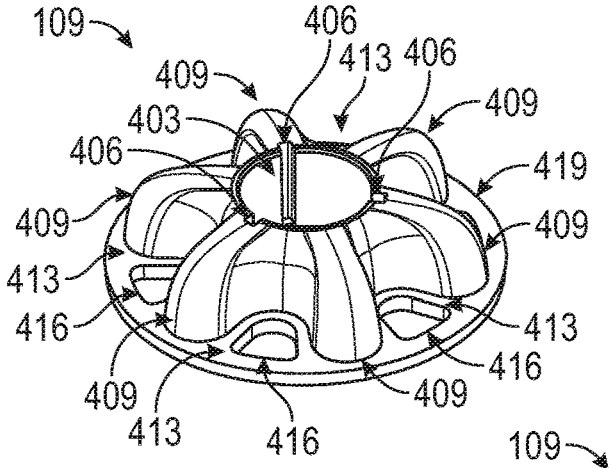
FIGS. 4A-4E are drawings of an insert for the garbage disposal stopper/strainer, according to various embodiments of the present disclosure.

FIG. 4A provides for a perspective view of the insert 109, according to various embodiments of the present disclosure. The insert 109 includes a hollow shaft 403 extending through the insert 109. The wall of the hollow shaft 403 of the insert 109 can include one or more grooves 406 disposed along the length of the hollow shaft 403. The ridges 319 (FIG. 3) of the top 106 (FIG. 3) may be configured to fit within the grooves 406 to help fasten the insert 109 to the top 106. The insert 106 can also include a number of fingers 409 placed in alignment with fingers 309 (FIG. 3) of the top 106 and shaped to fit within a portion of the hollow cavity of the top 106 corresponding to respective ones of the fingers 309 of the top 106. The fingers 409 may be configured or shaped to form a channel 413 between any two adjacent fingers 409. Located at the base of each channel 413 is a hole 416 in a rim 419 of the insert 109. The holes 416 allow for liquids guided by the channels 313 (FIG. 3) of the top 106 to pass through the rim 419 of the insert 109.

Figure 4B:
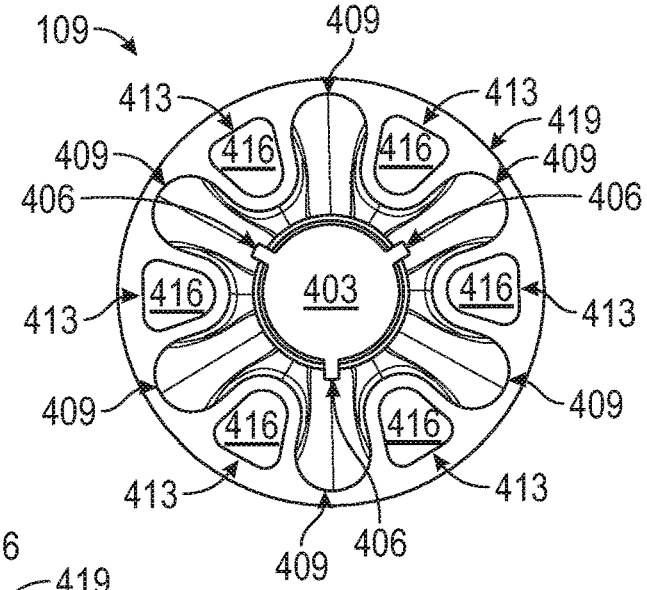

FIG. 4B is a top-down view of the insert 109, according to various embodiments of the present disclosure. As shown, the hollow shaft 403 includes one or more grooves 406 disposed on the wall of the hollow shaft 403. One or more fingers 409 extend from the hollow shaft 403. Channels 413 are formed between each pair of adjacent fingers 409. At the base of each channel is a hole 416 in the rim 419 of the insert 109.

Figure 4C:
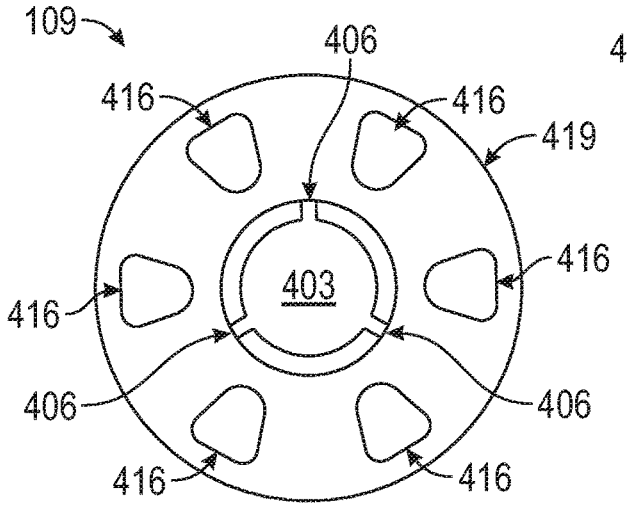

FIG. 4C is a bottom-up view of the insert 109, according to various embodiments of the present disclosure. As illustrated, one or more grooves 406 are present in the wall of the hollow shaft 403. Likewise, multiple holes 416 penetrate the rim 419 of the insert 109.

Figure 4D:
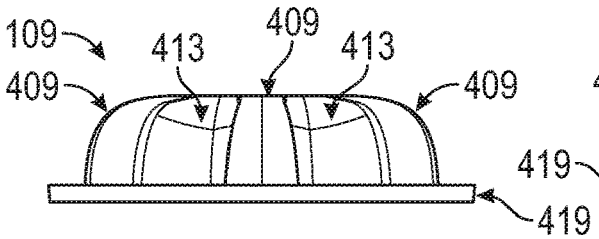

FIG. 4D is a side view of the insert 109, according to various embodiments of the present disclosure. As shown, multiple fingers 409 are disposed on the rim 419. Between each pair of adjacent fingers 409 is a channel 413.

Figure 4E:
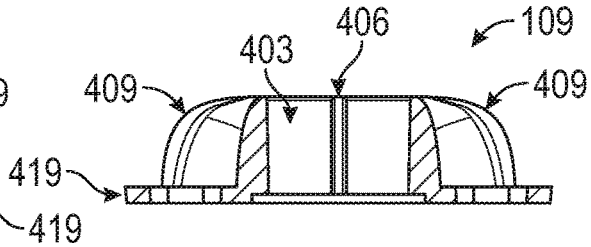

FIG. 4E is a cross-section of the side view of FIG. 4D. Several fingers 409 disposed on the rim 419 and the hollow shaft 403 are depicted. Within the hollow shaft 403, a groove 406 is disposed on the length of the wall of the hollow shaft 403.

FIGS. 4F-4I illustrate a plate 400 that may be used as an alternative to the insert 109 in some embodiments of the present disclosure.

Figure 4G:
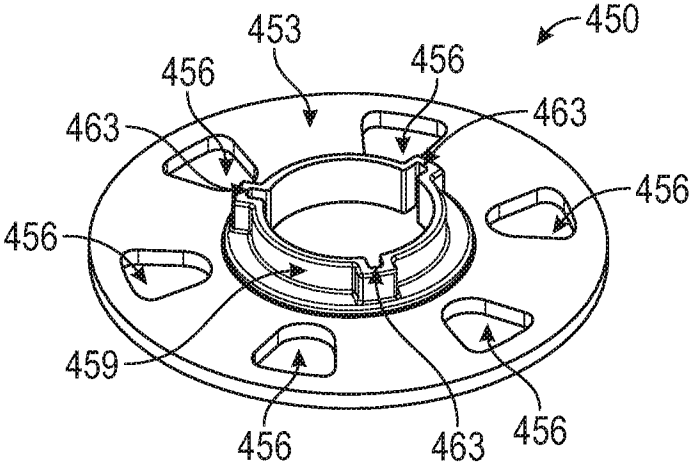
FIGS. 4F-4I are drawings of a plate used as an alternative to the insert depicted in FIGS. 4F-4I, according to various embodiments of the present disclosure.
Figure 4I:
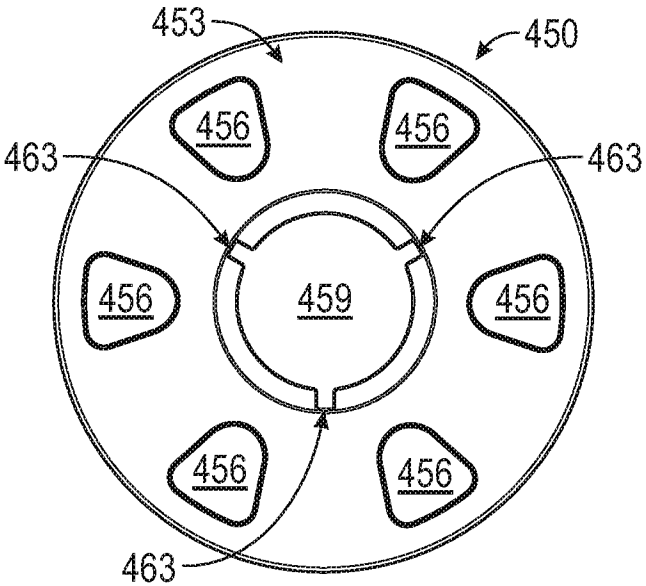
Figure 4F:
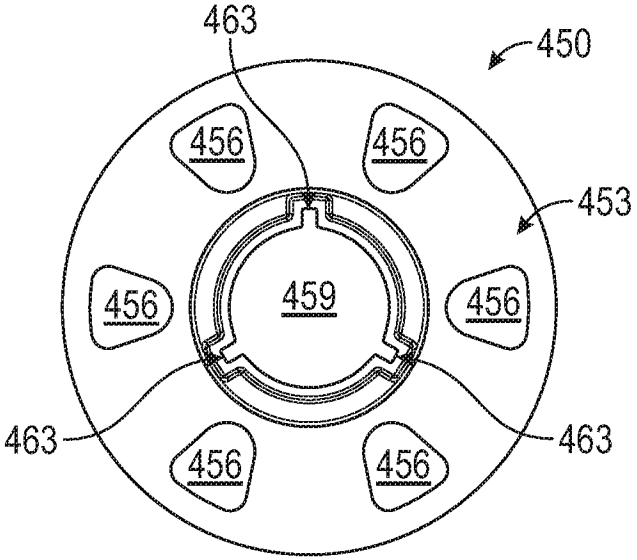

FIG. 4F represents a top-down view of the plate 400, according to various embodiments of the present disclosure. The plate 450 includes a rim 453 that includes one or more holes 456. The holes 456 allow for liquids guided by the channels 313 (FIG. 3) of the top 106 to pass through the rim 453 of the plate 450 A hollow shaft 459 may also pass through the plate 450 and be configured to allow the hollow shaft 303 (FIG. 3) of the top 106 to fit within the hollow shaft 303. Accordingly, the hollow shaft 459 of the plate 450 may include one or more grooves 463 disposed on the wall of the hollow shaft 459 or formed by the wall of the hollow shaft 459, as illustrated. The ridges 319 (FIG. 3) of the top 106 (FIG. 3) may be configured to fit within the grooves 463 to help fasten the plate 450 to the top 106.

FIG. 4G is a perspective view illustrating the plate 450, according to various embodiments of the present disclosure. As illustrated, the plate 450 includes a rim 453 that includes one or more holes 456. A hollow shaft 459 passes through the plate 450. One or more grooves 463 may be either disposed on the interior wall of the hollow shaft 459 or be formed by the wall of the hollow shaft 459, as illustrated.

Figure 4H:
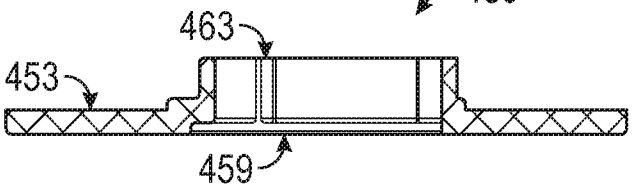

FIG. 4H is a cross-section view from the side of the plate 450, according to various embodiments of the present disclosure. As illustrated, the plate 450 includes a rim 453. A hollow shaft 459 passes through the plate 450. One or more grooves 463 may be either disposed on the interior wall of the hollow shaft 459 or be formed by the wall of the hollow shaft 459, as illustrated.

FIG. 4I depicts a bottom-up view of the plate 450, according to various embodiments of the present disclosure. As illustrated, the plate 450 includes a rim 453 that includes one or more holes 456. A hollow shaft 459 passes through the plate 450. One or more grooves 463 may be either disposed on the interior wall of the hollow shaft 459 or be formed by the wall of the hollow shaft 459, as illustrated.

FIGS. 5A-5D illustrate in further detail the base 113 of the garbage disposal stopper/strainer 100, according to various embodiments of the present disclosure.

Figure 5A:
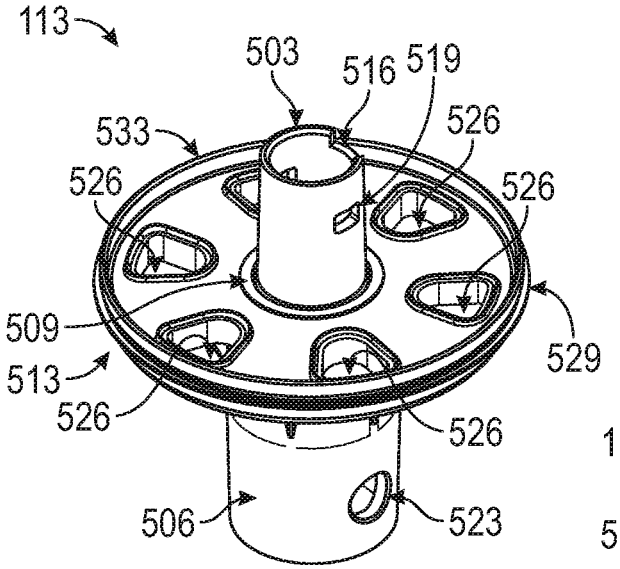
FIGS. 5A-5D are drawings of a base of the garbage disposal stopper/strainer, according to various embodiments of the present disclosure.

FIG. 5A is a perspective view of the base 113, according to various embodiments of the present disclosure. The base 113 includes a first hollow shaft 503 extending from a second hollow shaft 506 of a larger diameter. The first hollow shaft 503 fits through a hole 509 in an overmold 513 disposed on the base 113.

The first hollow shaft 503 has a notch 516 in the rim of the first hollow shaft 503. The stud 306 (FIG. 3) of the top 106 can be configured to fit within the notch 516. The combination of the notch 516 and the stud 306 limits the amount or degree of travel of the top 106 as it is rotated to change the garbage disposal stopper/strainer between an open and a closed state.

The first hollow shaft 503 can also have one or more holes 519 that allow for liquids that enter the first hollow shaft 503 to drain into the space between the top 106 and the insert 109. Such liquids can then drain through a previously described hole 316 in the top 106. Liquids may enter the first hollow shaft 503, for example, when the garbage disposal stopper/strainer 100 is in the closed position and a volume of liquid is trapped in a sink, resulting in the liquid resting on top of the garbage disposal stopper/strainer 100. The holes 519 may also provide an anchor to which the fasteners 219 (FIG. 2) of the cap 103 (FIG. 2) can attach or engage, thereby securing the cap 103 to the base 113.

The second hollow shaft 506 can include one or more holes 523, which can serve as attachment or anchor points for the scrapper 116, as later described in this application. Accordingly, the second hollow shaft 506 may be of sufficient size to allow the scraper 116 to be inserted inside the second hollow shaft 506. The second hollow shaft 506 also provides a support for the overmold 513, as described later in the application.

The overmold 513 is disposed on the second hollow shaft 506 and includes a number of components that contribute to the functionality of the garbage disposal stopper/strainer 100. The overmold 513 can include a number of holes 526 that allow for liquids to pass through the overmold 513 when the holes 416 (FIG. 4) of the insert 109 (FIG. 4) are in alignment. The top 106 (FIG. 3) can be rotated to place the holes 416 of the insert 109 into or out of alignment with the holes 526 in the overmold 513. The overmold 513 can also include a rim 529 disposed along an external surface of the overmold 513. The rim 529 can form at least a partial seal with the walls of a drain, thereby preventing liquid from passing through the drain when the holes 526 of the overmold 513 are out of alignment with the holes 416 of the insert 109. The overmold 513 can also include a lip 533 in some embodiments of the present disclosure. The overmold 513 can be made of various flexible materials, such as rubber, silicone, or similar materials. The use of flexible materials allows for the rim 529 of the overmold 513, as well as the overmold 513 itself, to flex and fit drains of various sizes.

Figure 5B:
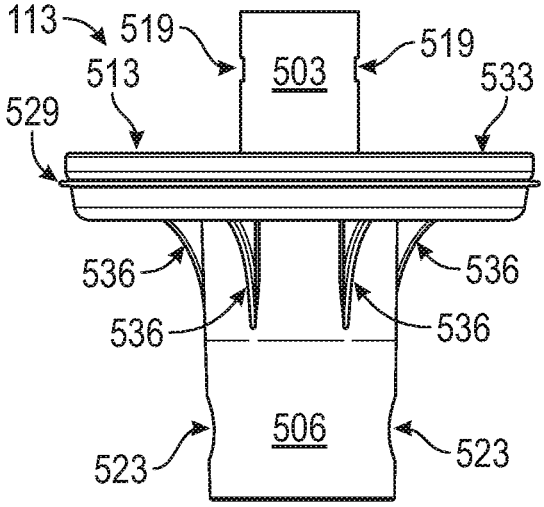

FIG. 5B is side-view of the base 113 according to various embodiments of the present disclosure. As illustrated, a first hollow shaft 503 extends from the second hollow shaft 506 through a hole 509 (FIG. 5B) in the overmold 513. One or more holes 519 are located on the sides of the first hollow shaft 503. Similarly, one or more holes 523 are located on the sides of the second hollow shaft 506. The overmold 513 also includes a rim 529 disposed on the circumference of the overmold 513 and a lip 533 disposed on the circumference of the overmold 513.

Additional features or components of the base 113 can also be viewed from the side-view. For example, the side-view illustrates that the base 113 includes one or more brackets 536 disposed on the exterior of the second hollow shaft 506. The overmold 513 is disposed on the brackets 536. The brackets 536 provide support to the overmold 513, preventing it from flexing, bending, or collapsing from the weight of liquids above the garbage disposal stopper/strainer 100 when the garbage disposal stopper/strainer 100 is closed and used as a sink stopper.

Figure 5C:
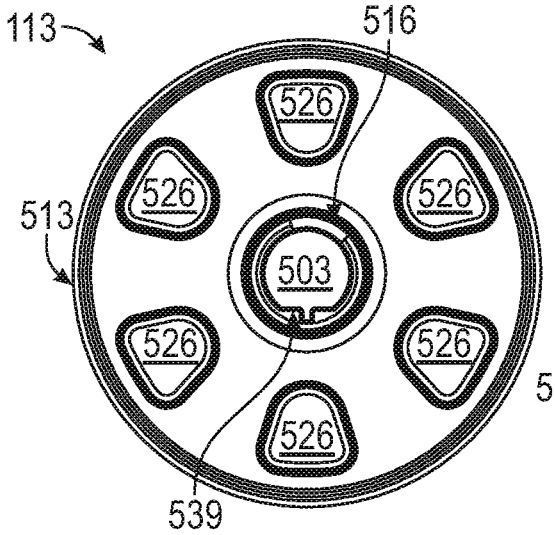

FIG. 5C is a top-down view of the base 113 according to various embodiments of the present disclosure. Each of the holes 526 in the overmold 513 are depicted. Also depicted is the notch 516 in the first hollow shaft 503.

Additional features or components of the base 113 can also be viewed in the top-down view of FIG. 5C. For example, a groove 539 disposed on an interior wall of the first hollow shaft 503 is depicted. The groove 539 can be of sufficient size and shape to allow the ridge 213 (FIG. 2) of the cap 103 to fit within the groove 539, minimizing any rotation of the cap 103 while fastened to the base 113.

Figure 5D:
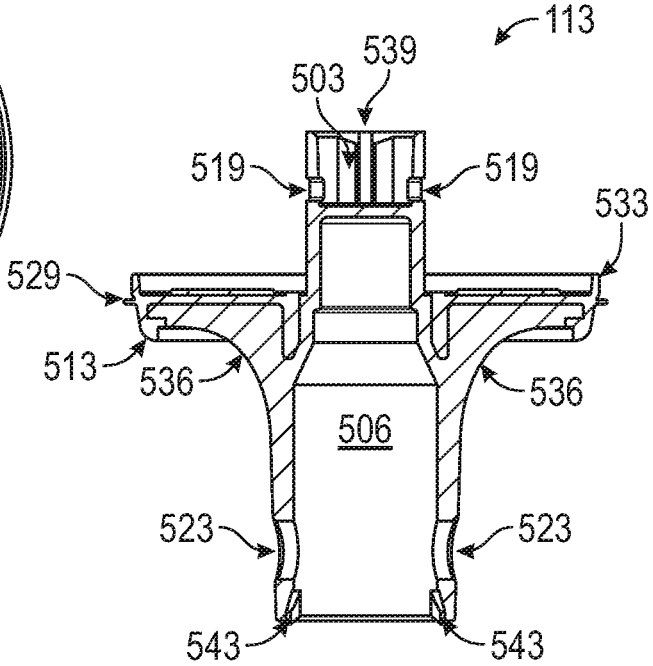

FIG. 5D depicts a cross-section of the base 113 according to various embodiments of the present disclosure. The first hollow shaft 503 and the second hollow shaft 506 are depicted. Within the first hollow shaft 503, the groove 539 is visible, as are one or more holes 519 in the wall of the first hollow shaft 503. The overmold 513 is also illustrated, including the rim 529 and lip 533 of the overmold 513. The brackets 536 supporting the overmold 513 are also depicted, as is how the overmold 513 is disposed on the base 113 and the brackets 536. The second hollow shaft 506 is also illustrated, including one or more holes 523 in the second hollow shaft 506.

Additional features or components of the base 113 can also be viewed in the cross-section of FIG. 5D. For example, one or more indentations 543 in the interior wall of the rim of the second hollow shaft 506 are illustrated. The indentations 543 provide for a gap between the interior wall of the rim of the second hollow shaft 506 and the scraper 116 (FIG. 1) when the scraper 116 is inserted into second hollow shaft 506. The indentations 543 therefore allow liquids that enter the second hollow shaft 506 to drain from the second hollow shaft 506 when the scraper 116 is inserted in the second hollow shaft 506.

FIGS. 6A-6D illustrate in further detail the scraper 116 of the garbage disposal stopper/strainer 100, according to various embodiments of the present disclosure.

Figure 6A:
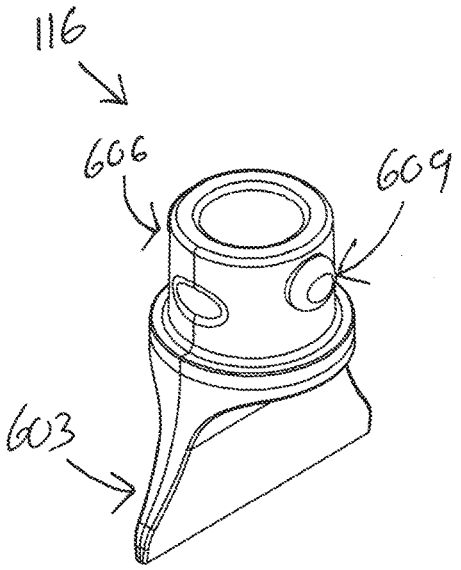
FIGS. 6A-6D are drawings of a scraper of the garbage disposal stopper/strainer, according to various embodiments of the present disclosure.

FIG. 6A depicts a perspective-view of the scraper 116, according to various embodiments of the present disclosure. The scraper 116 can be used to scrape debris off of surfaces, such as food scraps or leftovers off of a plate, cutting board, or other item. The scraper 116 can be manufactured from rubber, silicone, or similar flexible materials in order to prevent the scraper 116 from damaging items being scraped.

The scraper 116 has a number of components. The components include a blade 603, a tang 606, and a stud 609. The blade 603 can be used to scrape debris. In some embodiments, the blade 603 may taper as it extends from the tang 606. In some embodiment, the blade 603 may widen as it extends from the tang 606. The tang 606 can be configured to fit within the second hollow shaft 506 (FIG. 5) of the base 113 (FIG. 5). One or more studs 609 can be disposed on the wall of the tang 606. The stud 609 can be fit into a respective hole 523 (FIG. 5) in the wall of the second hollow shaft 506 of the base 116 to fasten the scraper 116 to the base 113.

Figure 6B:
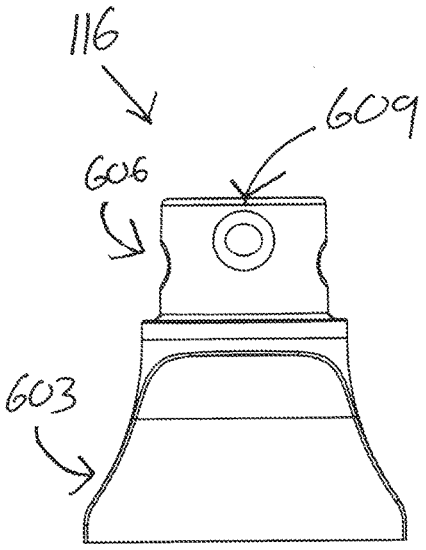

FIG. 6B depicts a side-view of the scraper 116, according to various embodiments of the present disclosure. Depicted are the blade 603, the tang 606, and a stud 609.

Figure 6C:
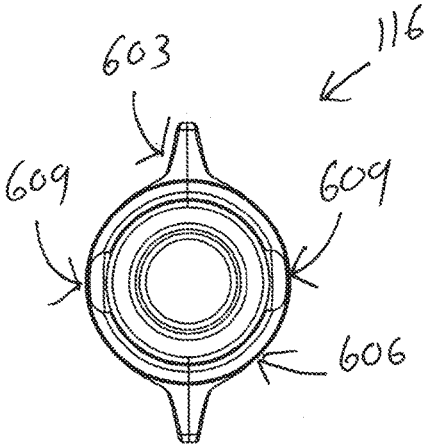

FIG. 6C depicts a top-down view of the scraper 116, according to various embodiments of the present disclosure. The blade 603 is depicted, as are multiple studs 609 disposed on the tang 606.

Figure 6D:
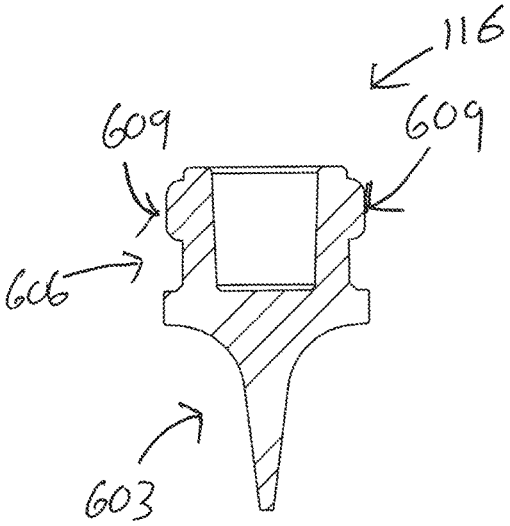

FIG. 6D is a cross-section of the scraper 116, according to various embodiments of the present disclosure. Illustrated are the blade 603, the tang 606, and one or more studs 609 disposed on the tang 606.

Figure 7:
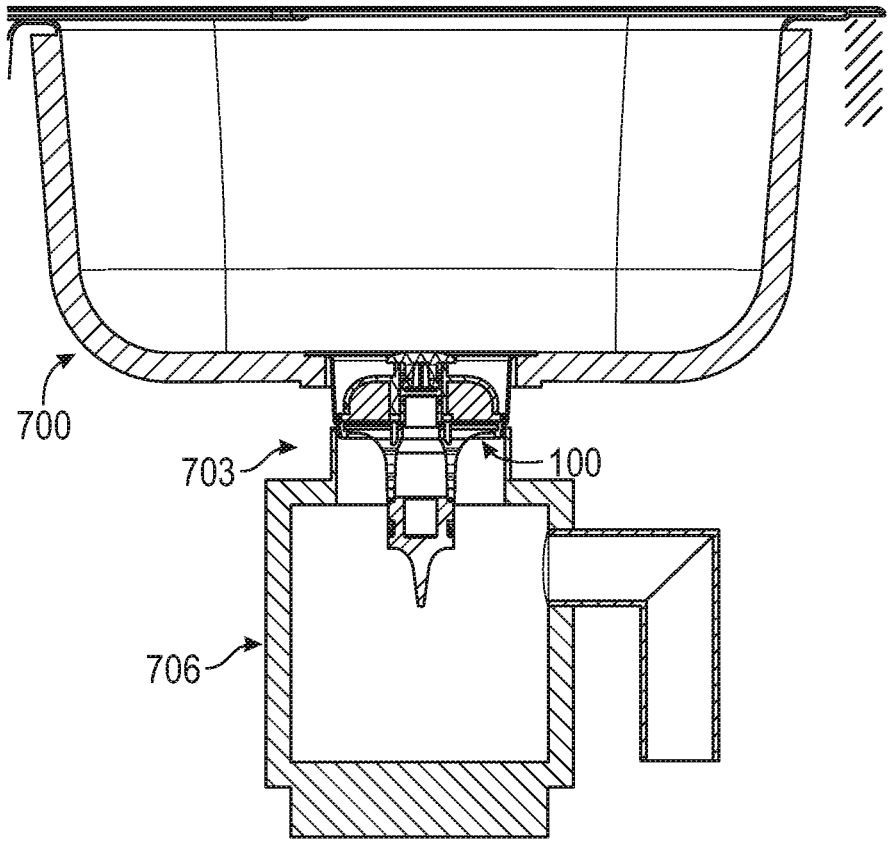
FIG. 7 is a cross-sectional view of the garbage disposal stopper/strainer, disposed within a sink, according to various embodiments of the present disclosure.

FIG. 7 illustrates a cross-sectional view of depicting the use of the garbage disposal stopper/strainer 100 with a sink 700, according to various embodiments of the present disclosure. As illustrated, the garbage disposal stopper/strainer 100 is placed within the drain 703 of the sink. The rim 529 (FIG. 5) of the overmold 513 (FIG. 5) of the base 113 forms at least a partial seal with the walls of the drain 703. When the holes 416 (FIG. 4) of the insert 109 (FIG. 4), or the holes 456 (FIG. 4G) of the plate 450 (FIG. 4G), are aligned with the holes 526 (FIG. 5) of the overmold 513, liquids in the sink 700 flow over the top 106 (FIG. 1 and FIG. 3) of the garbage disposal stopper/strainer 100 and through the holes 416 of the insert 109, or the holes 456 of the plate 450, and the holes 526 of the overmold, passing through the drain 703 and into the garbage disposal 706. When the holes 416 of the insert 109, or the holes 456 of the plate 450, are placed out of alignment with the holes 526 of the overmold (e.g., when the top 106 is rotated), liquids in the sink 700 are prevented from moving past the garbage disposal stopper/strainer 100 and therefore remain in the sink 700.

Disjunctive language such as the phrase "at least one of X, Y, or Z," unless specifically stated otherwise, is otherwise understood with the context as used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

Therefore, the following is claimed:

1. An apparatus, comprising:
a base;
a top comprising a cavity, a base, a first shaft, a channel, a stud on an interior wall of the first shaft, and a ridge on an external wall of the first shaft;
an insert configured to fit within the cavity of the top, the insert further comprising a second shaft; and
a cap configured to fit through the first shaft in the top and the second shaft in the insert and engage the base, the cap comprising a rim extending past the external wall of the first shaft.

2. The apparatus of claim 1, wherein the channel is a first channel, the interior wall of the first shaft is a first interior wall, and the insert further comprises:
a second channel configured to fit within the first channel; and
a groove within a second interior wall of the second shaft in the insert, the ridge on the exterior wall of the first shaft being configured to fit within the groove within the second interior wall of the second shaft.

3. The apparatus of claim 1, wherein the base further comprises:
a plurality of brackets; and
an overmold disposed on the plurality of brackets, the overmold comprising a hole alignable with an end of the channel of the top.

4. The apparatus of claim 3, wherein the overmold is a rubber overmold.

5. The apparatus of claim 1, wherein:
the base further comprises a third shaft, the third shaft including a notch in a lip of the third shaft of the base; and
the stud on the interior wall of the first shaft of the top fits within the notch in the lip of the third shaft of the base.

6. The apparatus of claim 1, wherein the insert is a rubber insert.

7. The apparatus of claim 1, wherein:
the base further comprises a third shaft, the third shaft comprising:
a hole in a wall of the third shaft, and
a groove in an interior of the wall of the third shaft; and
the top further comprises:
a clip configured to fit within the hole in the wall of the third shaft of the base, and
a ridge configured to fit within the groove in the interior of the wall of the third shaft of the base.

8. The apparatus of claim 1, the base further comprises a hollow shaft, and the apparatus further comprises a scraper configured to fit within the hollow shaft of the base.

9. The apparatus of claim 8, wherein the hollow shaft comprises a hole in a wall of the hollow shaft and the scraper is a flexible scraper comprising a blade, a tang, and a stud disposed on the wall of the tang, the tang fitting within the hollow shaft of the base and the stud fitting within the hole in the wall of the hollow shaft.

10. A device, comprising:
a base;
a top comprising:
a cavity;
a first channel;
a first shaft;
a stud on a first interior wall of the first shaft; and
a ridge on the exterior wall of the first shaft;
an insert configured to fit within the cavity of the top, the insert further comprising:
a second shaft;
a second channel configured to fit within the first channel; and
a groove within a second interior wall of the second shaft in the insert, the ridge on the exterior wall of the first shaft being configured to fit within the groove within the second interior wall of the second shaft; and
a cap configured to fit through the first shaft in the top and the second shaft in the insert and engage the base, the cap comprising a rim extending past an external wall of the first shaft.

11. The device of claim 10, wherein the base further comprises:
a plurality of brackets; and
a rubber overmold disposed on the plurality of brackets, the rubber overmold comprising a hole alignable with an end of the first channel of the top.

12. The device of claim 10, wherein:
the base further comprises a third shaft, the third shaft including a notch in a lip of the third shaft of the base; and
the stud on the first interior wall of the first shaft of the top fits within the notch in the lip of the third shaft of the base.

13. The device of claim 10, wherein the insert is a rubber insert.

14. The device of claim 10, wherein:
the base further comprises a third shaft, the third shaft comprising:
a hole in a wall of the third shaft, and
a groove in an interior of the wall of the third shaft; and
the top further comprises:
a clip configured to fit within the hole in the wall of the third shaft of the base, and
a ridge configured to fit within the groove in the interior of the wall of the third shaft of the base.

15. The device of claim 10, wherein the cavity is a first cavity, the base further comprises a second cavity, and the device further comprises a scraper configured to fit within the second cavity of the base.

16. An apparatus
a top comprising:
a cavity;
a first channel;
a first shaft;
a stud on a first interior wall of the first shaft; and
a ridge on the exterior wall of the first shaft;
a rubber insert configured to fit within the cavity of the top, the rubber insert further comprising:
a second shaft;
a second channel configured to fit within the first channel; and
a groove within a second interior wall of the second shaft in the rubber insert, the ridge on the exterior wall of the first shaft being configured to fit within the groove within the second interior wall of the second shaft;

a base comprising:

a third shaft;

a plurality of brackets; and a rubber overmold disposed on the plurality of brackets, the rubber overmold comprising a hole alignable with an end of the first channel of the top;

a cap configured to fit through the first shaft in the top and the second shaft in the rubber insert and engage the base, the cap comprising a rim extending past an external wall of the first shaft; and a flexible scraper comprising:

a blade;

a tang; and a stud disposed on a wall of the tang, the tang fitting within the third shaft of the base and the stud fitting within the hole in the wall of the third shaft.

17. The apparatus of claim 16, wherein the top further comprises a plurality of fingers and a plurality of channels, each of the plurality of channels being formed between adjacent ones of the plurality of fingers and the first channel of the top is one of the plurality of channels of the top.

18. The apparatus of claim 17, wherein each of the plurality of fingers includes a hole located at a bottom portion of each of the plurality of fingers.

19. The apparatus of claim 16, wherein the third shaft of the base comprises a hole located in wall of the third shaft.

* * * * *